US010777107B2

(12) United States Patent
Dai

(10) Patent No.: US 10,777,107 B2
(45) Date of Patent: Sep. 15, 2020

(54) ARRAY SUBSTRATE, TESTING METHOD AND DISPLAY APPARATUS

(71) Applicant: Wuhan China Star Optoelectronics Technology Co., Ltd., Wuhan, Hubei (CN)

(72) Inventor: Ronglei Dai, Guangdong (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 328 days.

(21) Appl. No.: 15/744,421

(22) PCT Filed: Nov. 25, 2017

(86) PCT No.: PCT/CN2017/112986
§ 371 (c)(1),
(2) Date: Jan. 12, 2018

(87) PCT Pub. No.: WO2019/085098
PCT Pub. Date: May 9, 2019

(65) Prior Publication Data

US 2019/0130802 A1 May 2, 2019

(30) Foreign Application Priority Data

Oct. 31, 2017 (CN) ..... 2017 1 1048840

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2330/12* (2013.01)

(58) Field of Classification Search
CPC ... G09G 2330/12; G09G 3/006; G09G 3/3648
See application file for complete search history.

(56) References Cited

U.S. PATENT DOCUMENTS

2002/0085169 A1 7/2002 Choi
2015/0279289 A1* 10/2015 Yu ..... G11C 19/28 345/690

(Continued)

FOREIGN PATENT DOCUMENTS

CN 1804708 A 7/2006
CN 101221330 A 7/2008

(Continued)

OTHER PUBLICATIONS

Translation of CN106847145 (Year: 2020).*

(Continued)

*Primary Examiner* — Huy Q Phan
*Assistant Examiner* — Adam S Clarke
(74) *Attorney, Agent, or Firm* — Hemisphere Law, PLLC; Zhigang Ma

(57) ABSTRACT

Embodiments of the present application provides an array substrate, testing method and display apparatus. The array substrate comprises a testing circuit, pixel units and data lines connecting to the pixel units. The data lines are used for providing data signals to the pixel units and are arranged to extend along a first direction. The testing circuit comprises a switching unit and testing units. The switching unit comprises a first number of first switching elements parallelly arranged along the first direction, and the testing units are parallelly arranged along a second direction perpendicular to the first direction. By using the present application, performance of substrate testing can be ensured while achieving narrow boarder, and user experiences could be easily improved.

12 Claims, 3 Drawing Sheets

(56) References Cited

U.S. PATENT DOCUMENTS

| | | | | |
|---|---|---|---|---|
| 2016/0260367 | A1* | 9/2016 | Kwak | G09G 3/3291 |
| 2016/0351143 | A1* | 12/2016 | Tian | G09G 3/3648 |
| 2016/0370413 | A1* | 12/2016 | Lu | G06F 3/14 |
| 2017/0148404 | A1* | 5/2017 | Xing | G09G 3/3648 |
| 2017/0294154 | A1* | 10/2017 | Takeuchi | G01R 19/16533 |

FOREIGN PATENT DOCUMENTS

| | | | |
|---|---|---|---|
| CN | 102687188 | A | 9/2012 |
| CN | 105319790 | A | 2/2016 |
| CN | 105372888 | A | 3/2016 |
| CN | 105427775 | A | 3/2016 |
| CN | 206096714 | U | 4/2017 |
| CN | 206097859 | U | 4/2017 |
| CN | 206209225 | U | 5/2017 |
| CN | 106847145 | A | 6/2017 |

OTHER PUBLICATIONS

Chinese Office Action issued in corresponding Application No. 201711048840.5 dated May 13, 2019, pp. 1-8, Chinese Patent Office, Beijing, China.

* cited by examiner

ARRAY SUBSTRATE, TESTING METHOD AND DISPLAY APPARATUS

RELATED APPLICATIONS

The present application is a National Phase of International Application Number PCT/CN2017/112986, filed on Nov. 25, 2017, and claims the priority of China Application No. 201711048840.5, filed on Oct. 31, 2017.

FIELD OF THE DISCLOSURE

The disclosure relates to a testing apparatus, and more particularly to an array substrate, testing method and display apparatus.

BACKGROUND

With continuous development, Liquid Crystal Display (LCD) is widely used as the display device of electronic products, such as mobile phone, digital camera, TV, computer, etc. With the increased requirements on LCD display quality, the narrow border design of LCD has become an important technique to be researched. A narrow border LCD can effectively reduce the width of the splicing seam in the splicing screen, significantly increase effective areas of displayed image to improve the overall display quality, and be beneficial for immersion of the viewer.

During the process for manufacturing LCD, the yield rate of products is not high because of the complicated process of the array substrate. In order to improve the yield rate of the products after the box is formed, an array test for testing the display elements and circuits on the substrate should be performed after the array substrate is accomplished. The result of the test on the substrate is very important for the subsequent maintenance. Generally, the test circuit for testing the substrate is located at the border so that a challenge for achieving narrow border occurs. Therefore, it is a problem needs to be solved urgently that how to achieve the effect of narrow border while ensuring performance of substrate testing.

SUMMARY

Embodiments of the present invention provides an array substrate which is capable of achieving the effect of narrow border while ensuring performance of substrate testing.

Furthermore, a display apparatus comprising the array substrate mentioned above is provided.

Furthermore, a testing method of the array substrate mentioned above is provided.

In a first aspect, the embodiments of the present invention provide an array substrate. The array substrate comprises a display area and a non-display area formed around boundaries of the display area, wherein the display area comprises a plurality of pixel units arranged in matrix for displaying an image and a plurality of data lines for connecting the pixel units, the data lines are used for providing data signals to the pixel units and are extended along a first direction, and the non-display area comprises a testing circuit. The testing circuit comprises: a test switching control terminal to which a test switching control signal is input; a first test control terminal to which a low voltage level signal is input; a first number of a plurality of second test control terminals to which a test signal is input; a switching unit comprising the first number of a plurality of first switching elements, wherein the first switching elements are parallelly arranged along the first direction and are connected to the test switching control terminal and the first test control terminal, and the switching unit controls the array substrate to be in a non-testing status in accordance with the test switching control signal; and a plurality of testing units parallelly arranged along a second direction perpendicular to the first direction, wherein each of the testing units is connected to the switching unit, the first number of the second test control terminals and the first number of corresponded data lines, and the testing units test electrical characteristics of the corresponded data lines and pixel units when the switching unit controls the array substrate to be in a testing status in accordance with the test switching control signal.

In a second aspect, the embodiments of the present invention provide a testing method for testing pixel array in an array substrate. The array substrate comprises a display area and a non-display area formed around boundaries of the display area, the display area comprises a plurality of pixel units arranged in matrix for displaying an image and a plurality of data lines for connecting the pixel units, the data lines are used for providing data signals to the pixel units, the non-display area comprises a testing circuit, and the testing circuit comprises a test switching control terminal, a first test control terminal, a first number of a plurality of second test control terminals, a switching unit and a plurality of testing units, wherein the switching unit comprises the first number of a plurality of first switching elements parallelly arranged along a first direction, each of the first switching elements comprises a first control terminal, a first conducting terminal and a second conducting terminal, the testing units are parallelly arranged along a second direction perpendicular to the first direction, each of the testing units comprises a voltage input terminal and the first number of a plurality of second switching elements, the first switching elements are corresponding to the second switching elements one by one, and each of the second switching elements comprises a second control terminal, a third conducting terminal and a fourth conducting terminal. The testing method comprises: in a non-testing stage, controlling the first number of the first switching elements to be turned on and controlling a low voltage level signal input to the first test control terminal to be transmitted through the first number of the turned-on first switching elements to the corresponded second switching elements to terminate the second switching elements to cut off connections between the testing circuit and the data lines; and, in a testing stage, controlling the first number of the first switching elements to be terminated and controlling the testing units in accordance with a test signal input to the first number of the second test control terminals to test electrical characteristics of the corresponded data lines and pixel units.

In a third aspect, the embodiments of the present invention provide a display apparatus comprising the array substrate described in the first aspect above.

Comparing with the existed techniques, through parallelly arranging the first number of the first switching elements along the first direction and parallelly arranging the testing units along the second direction perpendicular to the first direction, the space in the first direction occupied by the testing circuit can be effectively decreased and narrow border can be achieved while ensuring performance of substrate testing.

BRIEF DESCRIPTION OF THE DRAWINGS

In order to make the descriptions of the technique solutions of the embodiments of the present invention or the existed techniques, the drawings necessary for describing the embodiments or the existed techniques are briefly introduced below. Obviously, the drawings described below are only some embodiments of the present invention, and, for those with ordinary skill in this field, other drawings can be obtained from the drawings described below without creative efforts.

DETAILED DESCRIPTION OF PREFERRED EMBODIMENTS

The technique solutions of the embodiments of the present invention will be clearly and fully described below accompanying with the drawings of the embodiments of the present invention. Obviously, the embodiments described below are only a part, but not all, of the embodiments of the present invention. Other embodiments obtained by those with ordinary skill in this art without creative efforts should belong to the protection scope of the present invention.

The array substrate, testing method and display apparatus provided by the embodiments of the present invention are described as follows.

Figure 1:
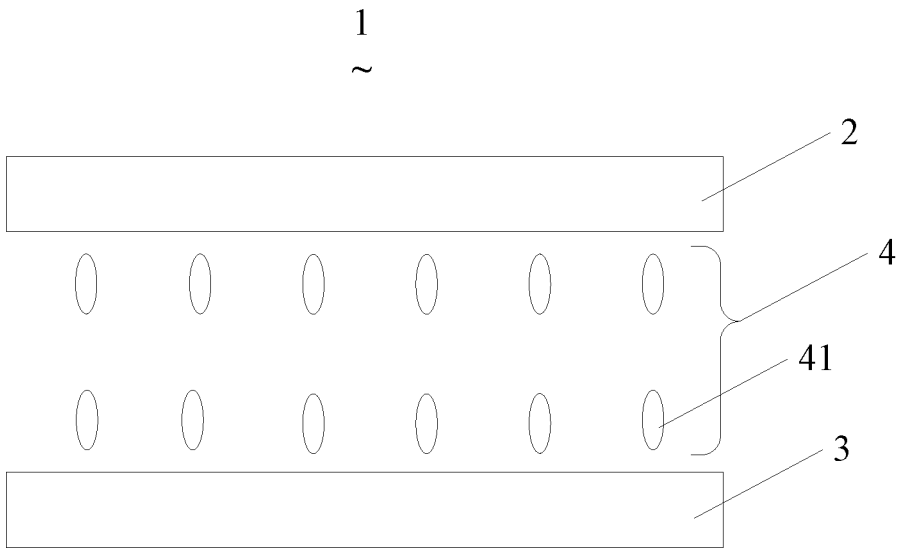
FIG. 1 is a structural schematic diagram of a display apparatus provided by one embodiment of the present invention.

Please refer to FIG. 1, which is a structural schematic diagram of a display apparatus 1 provided by one embodiment of the present invention. In the present embodiment, the display apparatus with liquid crystal (Liquid Crystal Display, LCD) is described as an example. Obviously, in other embodiments of the present invention, the display apparatus 1 could be, but not limited to, Electroluminescent (EL) display apparatus.

As shown in FIG. 1, the display apparatus 1 comprises: a color film substrate 2, an array substrate 3, and a liquid crystal layer 4 disposed between the color film substrate 2 and the array substrate 3. The liquid crystal layer comprises a plurality of liquid crystal molecules 41.

The array substrate 3 is disposed primarily with scan lines (not shown), data lines (not shown) and pixel electrodes (not show). The scan lines are disposed perpendicularly to the data lines. The pixel electrodes are formed within pixel areas defined by crossing of the scan lines and data lines. At least one switching element is disposed corresponding to one pixel electrode, and the switching element is generally accomplished by a Thin Film Transistor (TFT). Scan signals are transmitted through the scan lines to conduct the TFTs, and image signals transmitted by the data lines are applied to corresponded pixel electrodes through the TFTs to form electric field between the pixel electrodes and common electrodes on the color film substrate 2 to control twisting of the liquid crystal molecules for displaying images. In correspondence with each pixel unit, a color filtering material is formed on the color film substrate 2. The color filtering material filters lights passing through the liquid crystal layer 4 to realize color image displaying.

During the manufacturing process of the array substrate 3, it is necessary to detect defects through detecting procedures. For example, through comparison detection on the pixel patterns of the array substrate, the pattern defect or manufacturing defect can be detected. Generally, the detecting procedures are realized through designing testing circuits on the array substrate.

Figure 2:
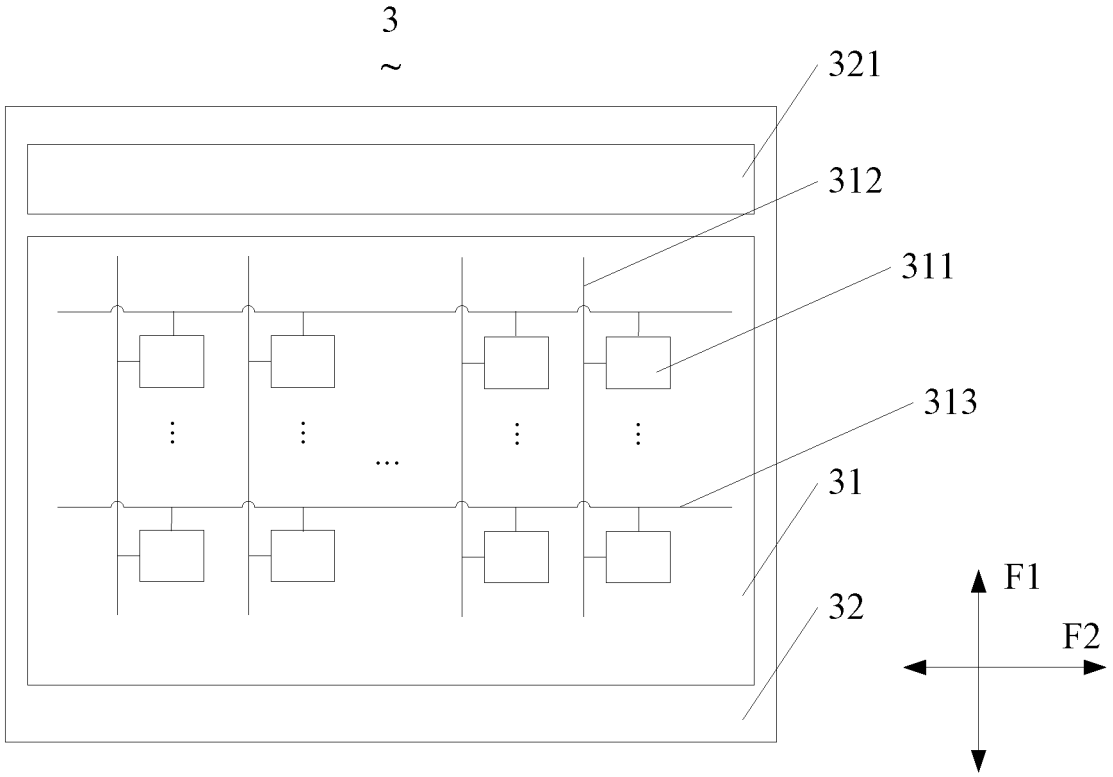
FIG. 2 is a structural schematic diagram of the array substrate in the display apparatus shown in FIG. 1.

Please refer to FIG. 2, which is a structural schematic diagram of the array substrate 3 shown in FIG. 1. As shown in FIG. 2, the array substrate 3 comprises: a display area 31 and a non-display area 32 formed around the boundaries of the display area 31. The display area 31 comprises a plurality of data lines 312 extended along a first direction F1 and parallelly arranged along the second direction F2, a plurality of scan lines 313 extended along the second direction F2 and parallelly arranged along the first direction F1, a plurality of pixel units 311 arranged in matrix and at intersections of the data lines 312 and the scan lines 313 for displaying images. The scan lines 313 control a row of the pixel units 311 connecting with the scan lines 313 for preparing to receive the data signals, and the data lines 312 provide the data signals to the pixel units 311 to display image.

The non-display area 32 comprises the testing circuit 321, wherein the testing circuit 321 is parallelly arranged with the display area 31 along the first direction F1. In the present embodiment, the first direction F1 is the same as the vertical or column direction of the array substrate 3, the second direction F2 is the same as the horizontal or row direction, and the testing circuit 321 is formed near the up side of the display area 31. It is noted that, the testing circuit 321 formed near the up side of the display area 31 is only an example and is not for limiting the present invention. The testing circuit 321 could be formed near other locations of the boundaries of the display area 31, such as left side, right side or down side.

Figure 3:
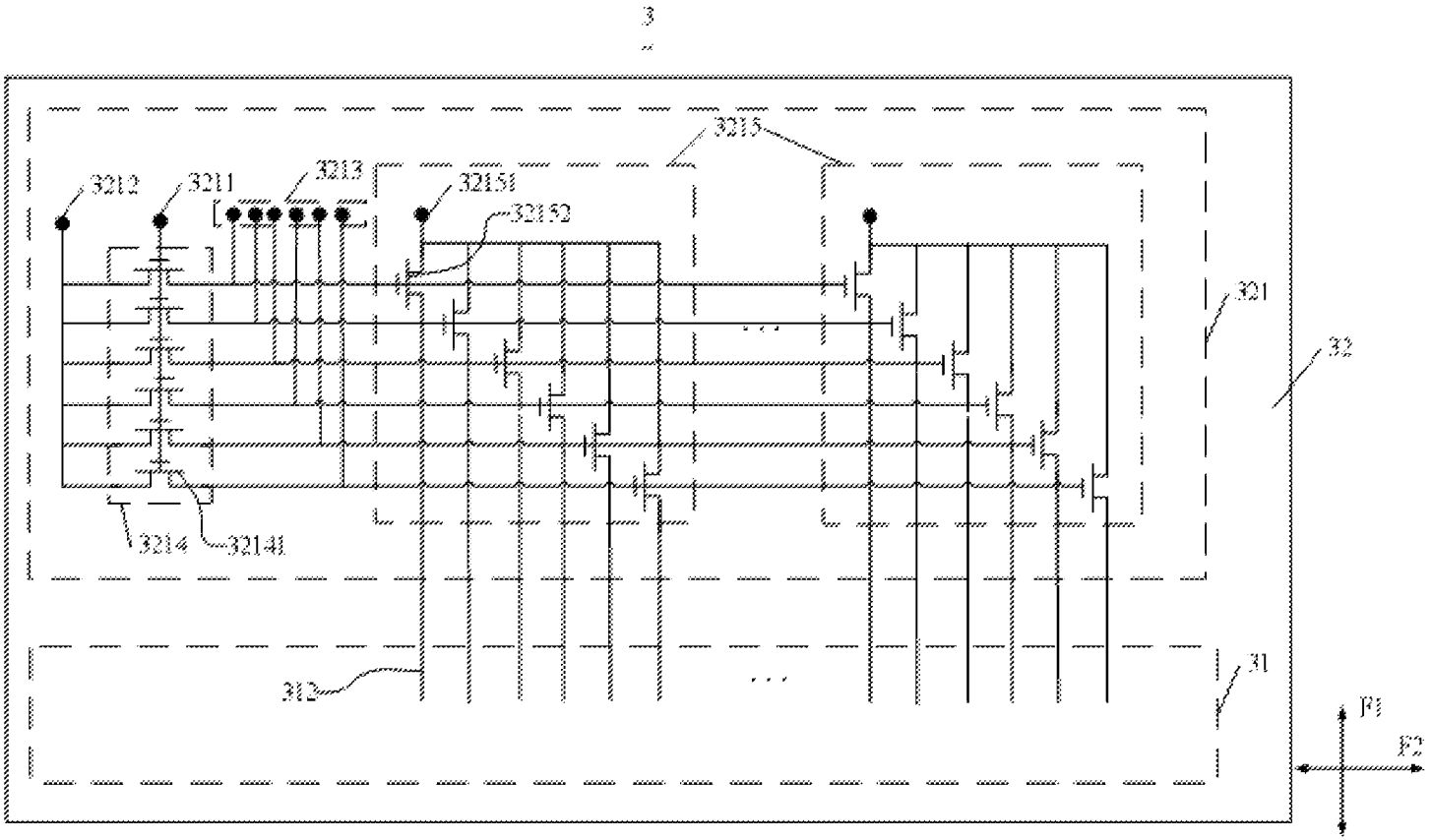
FIG. 3 is a schematic diagram of a testing circuit of the array substrate.

Please refer to FIG. 3, which is a schematic diagram of a testing circuit of the array substrate 3 shown in FIG. 3. As shown in FIG. 3, the testing circuit 321 comprises: a test switching control terminal 3211, a first test control terminal 3212, a first number of a plurality of second test control terminals 3213, a switching unit 3214 and a plurality of testing units 3215.

The test switching control terminal 3211 is used for inputting a test switching control signal ATEN, the first test control terminal 3212 is used for inputting a low voltage level signal, and the first number of the second test control terminals 3213 are used for inputting test signal SW.

The switching unit 3214 comprises the first number of the first switching elements 32141 parallelly arranged along the first direction F1. Each first switching element 32141 comprises a first control terminal c1, a first conducting terminal e1 and a second conducting terminal e2, wherein the first number of the first switching elements 32141 are parallelly connected to each other, the first conducting terminal e1 of each first switching element 32141 is connected to the first test control terminal 3212, the first control terminals c1 of the first number of the first switching elements 32141 are connected to the test switching control terminal 3211, and the second conducting terminals e2 of the first number of the first switching elements 32141 are connected to the testing units 3215.

The first control terminals c1 of the first switching elements 32141 are used for receiving the test switching control signal ATEN input to the test switching control terminal 3211 to turn on or terminate the first switching elements 32141, that is, ending or performing of the array substrate testing is controlled through turning on or terminating the first switching elements 32141.

The testing units 3215 are parallelly arranged along the second direction F2. Each testing unit 3215 comprises a voltage input terminal 32151 and the first number of a plurality of second switching elements 32152, wherein the first switching elements 32141 are corresponding to the second switching elements 32152 one by one, and the second switching element 32152 comprises a second control terminal c2, a third conducting terminal e3 and a fourth conducting terminal e4.

The voltage input terminal 32151 is used for inputting a voltage signal. The second control terminal c2 is used for controlling to turn on or terminate the second switching element 32152. When the second switching element 32152 is turned on, the voltage signal provided through the voltage input terminal 32151 is applied to the data line 312 through the second switching element 32152 to realize testing on the pixel unit 311.

It is noted that, the test signal received by the second control terminals c2 of the different second switching elements 32152 of the same test unit is a signal set provided by the second test control terminal 3213. Specifically, the signal set could be timing signals and control the different second switching elements 32152 to be turned on in different time. For example, when the test signal input by the second test control terminal 3213 in a first time period is 100000 (the first number used in this example is 6), the first one of the second switching elements 32152 is turned on and other five of the second switching elements 32152 are terminated. In another example, when the test signal input by the second test control terminal 3213 in a sixth time period is 000001, the last one of the second switching elements 32152 is turned off and other five of the second switching elements 32152 are terminated. It is noted that, the example described above are only a part but not all of the embodiments.

The second control terminal c2 of the second switching element 32152 is connected to the second conducting terminal e2 of the first switching element 32141 and the second test control terminal 3213, the third conducting terminal e3 of the second switching element 32152 is connected to the voltage input terminal 32151, and the fourth conducting terminal e4 of the second switching element 32152 is connected to one of the data lines 312.

The first switching element 32141 and the second element 32152 are three-terminal elements. Specifically, the first switching element 32141 and the second switching element 32152 could be thin film transistor (TFT), field effect transistor (FET) or other three-terminal elements having switching function. The TFT is used as an example of the first switching element 32141 and the second switching element 32152 in descriptions of the present embodiment, however, the present invention should not be limited to this example.

The switching unit 3214 comprises the first number of the first switching elements 32141. In the embodiments of the disclosure, the first number is 6 for example. In other embodiments of the present invention, the first number could be set to be, for example, 3, 4, 9, 12 or other quantities, in accordance with actual requirements.

Each testing unit 3215 comprises the first number of the second switching elements 32152, wherein, the second switching elements 32152 of each testing unit 3215 are corresponding to the first switching elements 32141 of the switching unit 3214 one by one, and each first switching element 32141 corresponds to a plurality of second switching elements 32152 in the plurality of testing units 3215, respectively. The total number of the second switching element 32152 in the testing circuit 321 is the same as the number of the data lines 312 in the display area 31.

Preferably, the number of the second switching elements 32152 corresponding to each first switching element 32141 is equal to the number of the testing units 3215 in the testing circuit 321. For example, when there are ten testing units 3215 in the testing circuit 321, each first switching element 32141 should be corresponding to ten second switching elements 32152, that is, the second conducting terminal e2 of each first switching element 32141 is connected to the second control terminals c2 of ten second switching elements 32152. In other words, each first switching element 32141 controls turning on or terminating of several second switching elements 32152 connected to the first switching element 32141, thereby controls inputting of several data lines 312 connected to the several second switching elements 32152, and thereby controls ending or performing of tests for pixel units 311 connected to the several data lines 312. Through controlling the testing circuit to perform electric characteristics test on the array substrate, failures such as short-circuit could be repaired by using laser cutting apparatus and is beneficial for increasing yield rate of products. At the same time, through using the first switching elements 32141 with multiplexed control circuit structure, number of the TFTs between the test control circuit and pixel array can be reduced. Therefore, number of the failure resources in the testing circuit can be reduced and thereby failure probability and cost of the substrate can be reduced.

In the present embodiment, through parallelly arranging the first number of the first switching elements 32141 along the first direction F1 and parallelly arranging the testing units 3215 along the second direction F2 perpendicular to the first direction F1, the space in the first direction F1 occupied by the testing circuit 321 can be effectively decreased, narrow border can be achieved while ensuring performance of substrate testing and it is helpful for improving watching experiences of users.

In a testing stage when the test switching control signal ATEN controls the array substrate 3 to be in a testing status, the testing units 3215 test the electric characteristics of corresponded data lines 312 and pixel units 311 in accordance with the test signal SW.

Preferably, the test switching control signal ATEN is input to the test switching control terminal 3211 in the testing stage, the first control terminal c1 of the first switching element 32141 connected to the test switching control terminal 3211 receives the test switching control signal ATEN, and the test switching control signal ATEN is a low potential signal to control the first switching element 32141 to be terminated. Optionally, the test switching control signal ATEN could be an OFF signal or VGL signal in the testing stage, wherein the VGL signal is a terminating voltage signal for the gate IC of the display apparatus 1.

Preferably, the test signal SW is input to the first number of the second test control terminals 3213 in the testing stage and the second control terminals c2 of the first number of the second switching elements 32152 connected to the first number of the second test control terminals 3213 receives the test signal SW, wherein the test signal SW is used for controlling the first number of the second switching elements 32152 to be turned on in different time.

Figure 4:
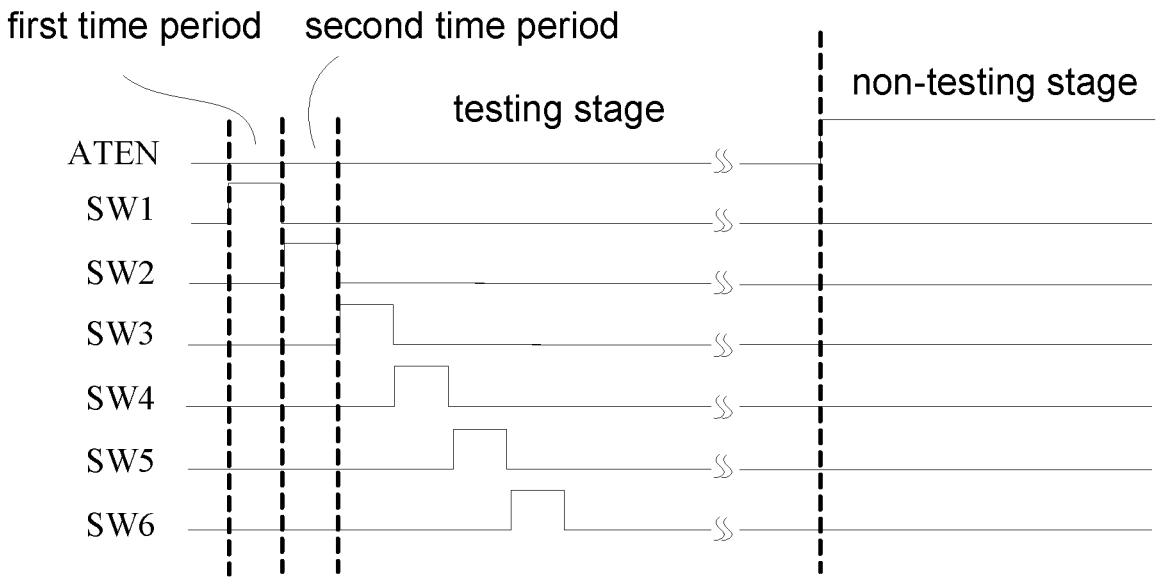
FIG. 4 is a control timing diagram of the testing circuit shown in FIG. 3.

Preferably, in the testing stage, the voltage signal is input to the voltage input terminal 32151, the third conducting terminal e3 of the second switching element 32152 connected to the voltage input terminal 32151 receives the voltage signal, and the voltage signal is transmitted through the turned-on second switching element 32152 to the corresponded data line 312. Please refer to FIG. 4, which is a control timing diagram of the testing circuit 321 shown in FIG. 3. It can be observed from FIG. 4 that, in the testing stage, the test switching control signal ATEN input to the test switching control terminal 3211 is low potential, and, when one set of the test signal input to the first number of the second test control terminal 3213 is 100000 (in first time period), 010000 (in second time period), 001000 (in third time period), 000100 (in fourth time period), 000010 (in fifth time period) and 000001 (in sixth time period), the sixth second switching elements 32152 of the testing unit 3215 are controlled to receive in different time period the corresponded test signal (in sequence: SW1, SW2, SW3, SW4, SW5, SW6). The test signal controls the six second switching elements 32152 to be turned on from the first time period to the sixth time period in sequence so that sixth data lines connected to the second switching elements 32152 could input data to corresponded pixel units 311 in different time periods to achieve test on pixel units 311. It is noted that the control timing diagram of the testing circuit 321 shown in FIG. 4 is only an example but not limitation of the present invention.

In the non-testing stage, the switching unit 3214 controls the array substrate 3 to be in a non-testing status in accordance with the test switching control signal ATEN.

Preferably, a low voltage level signal is input to the first test control terminal 3212. When the first switching element 32141 connected to the first test control terminal 3212 is turned on, the low voltage level signal is used for controlling the second switching element 32152 corresponding to the turned-on first switching element 32141 to be terminated to cut off connection between the testing circuit 321 and the pixel array to prevent normal operation of the pixel array from being affected by the testing circuit in the non-testing stage.

Preferably, in the non-testing stage, the test switching control signal ATEN is input to the test switching control terminal 3211, the first control terminal c1 of the first switching element 32141 connected to the test switching control terminal 3211 receives the test switching control signal ATEN, and the test switching control signal ATEN is high potential to control the first switching element 32141 to be turned on. Optionally, in the non-testing stage, the test switching control signal ATEN could be an ON signal or VGH signal, wherein the VGH signal is a driving voltage signal for the gate IC of the display apparatus 1.

Preferably, in the non-testing stage, the low voltage level signal input to the first test control terminal 3212 is transmitted through the turned-on first switching element 32141 to the corresponded second switching element 32152, and the second control terminal c2 of the second switching element 32152 receives the low voltage level signal to control the second switching element 32152 to be terminated to cut off the connections between the testing circuit 321 and the data lines 312.

It is noted that, in the non-testing stage, the test signal SW could also be the OFF signal, the low potential signal, the VGL signal or a floating signal. Because the low voltage level signal input to the first test control terminal 3212 can be transmitted through the first number of the turned-on first switching 32141 to the second switching elements 32152 and is capable of terminating the second switching elements 32152, the test signal SW input to the second test control terminal 3213 would not be transmitted to the second switching element 32152 and would not affect the testing procedure no matter what the test signal SW is.

As shown in FIG. 4, the second test control terminal is input by the floating signal in the non-testing stage and, when the test switching control signal ATEN input to the test switching control terminal 3211 is high potential to turn on the first number of the first switching elements 32141 connected to the test switching control terminal 3211, the low voltage level signal input to the first test control terminal 3212 is transmitted through the turned-on first switching elements 32141 to the second control terminals c2 of the second switching elements 32152 to terminate the second switching elements 32152 and cut off the connection between the testing circuit and the pixel array. Through this way, normal operations of the pixel array could be prevented from being affected by erroneously turning on the second switching elements 32152 connected to the second test control terminal 3213 due to floating of the second test control terminal 3213.

Therefore, through implementing the present embodiment, narrow border can be achieved while ensuring performance of substrate testing, failure probability and cost of the substrate can be reduced, and it is helpful for improving watching experiences of users.

Figure 5:
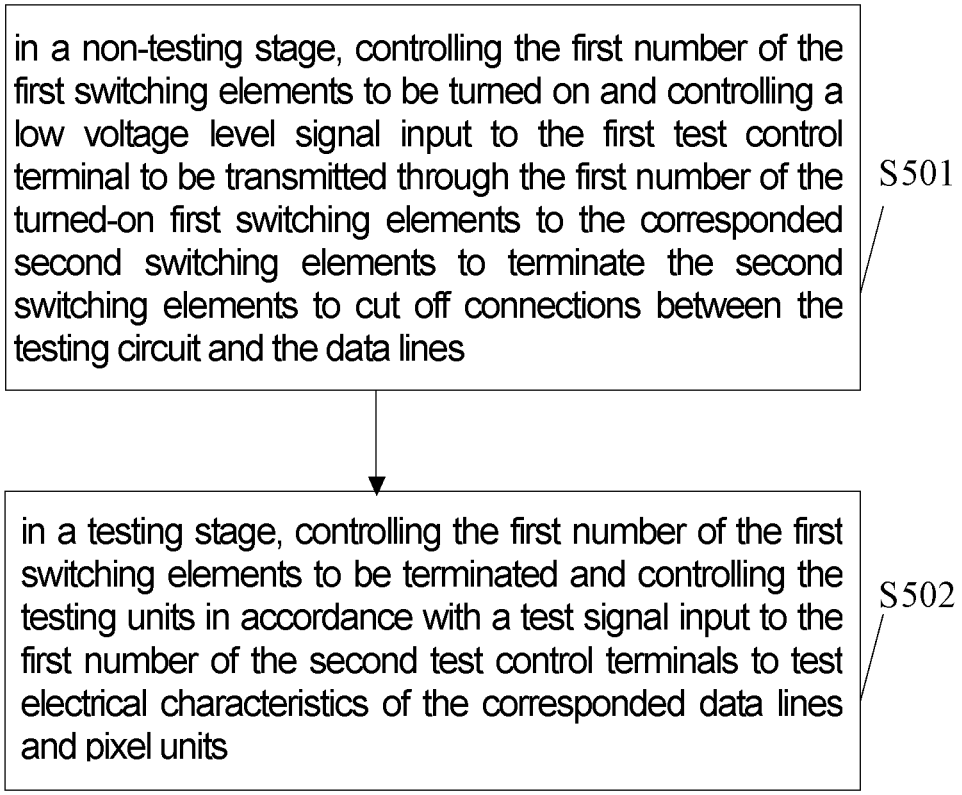
FIG. 5 is a flow chart of a testing method of the array substrate provided by one embodiment of the present invention.

Please refer to FIG. 5, which is a flow chart of a testing method provided by one embodiment of the present invention. The testing method is used for testing pixel array in an array substrate, the array substrate comprises a display area and a non-display area formed around boundaries of the display area, the display area comprises a plurality of pixel units arranged in matrix for displaying an image and a plurality of data lines for connecting the pixel units, the data lines are used for providing data signals to the pixel units, the non-display area comprises a testing circuit, and the testing circuit comprises a test switching control terminal, a first test control terminal, a first number of a plurality of second test control terminals, a switching unit and a plurality of testing units. Wherein, the switching unit comprises the first number of a plurality of first switching elements parallelly arranged along a first direction, each of the first switching elements comprises a first control terminal, a first conducting terminal and a second conducting terminal, the testing units are parallelly arranged along a second direction perpendicular to the first direction, each of the testing units comprises a voltage input terminal and the first number of a plurality of second switching elements, the first switching elements are corresponding to the second switching elements one by one, and each of the second switching elements comprises a second control terminal, a third conducting terminal and a fourth conducting terminal. The testing method could comprise:

S501, in a non-testing stage, controlling the first number of the first switching elements to be turned on and controlling a low voltage level signal input to the first test control terminal to be transmitted through the first number of the turned-on first switching elements to the corresponded second switching elements to terminate the second switching elements to cut off connections between the testing circuit and the data lines.

S502, in a testing stage, controlling the first number of the first switching elements to be terminated and controlling the testing units in accordance with a test signal input to the first number of the second test control terminals to test electrical characteristics of the corresponded data lines and pixel units.

Preferably, the array substrate controls the low voltage level signal to be input to the first test control terminal, and, when the first switching element connected to the first test control terminal is turned-on, the low voltage level signal controls the second switching element corresponding to the first switching element to be terminated.

Preferably, in the non-testing stage, the array substrate controls a high potential signal to be input to the test switching control terminal so that the first control terminals of the first number of the first switching elements connected to the test switching control terminal receive the high potential signal, wherein the high potential signal controls the first number of the first switching elements to be turned on.

Preferably, in the non-testing stage, the array substrate controls the low voltage level signal input to the first test control terminal to be transmitted through the turned-on first switching elements to the corresponded second switching elements so that the low voltage level signal is received by the second control terminals of the second switching elements, wherein the low voltage level signal controls the second switching elements to be terminated to cut off connections between the testing circuit and the data lines.

Preferably, in the testing stage, the array substrate controls a low potential signal to be input to the test switching control terminal so that the first control terminals of the first number of the first switching elements connected to the test switching control terminal receive the low potential signal, wherein the low potential signal controls the first switching elements to be terminated.

Preferably, in the testing stage, the array substrate controls the test signal to be input to the first number of the second test control terminals so that the second control terminals of the first number of the second switching elements connected to the second test control terminal receive the test signal, wherein the test signal is used for controlling the first number of the second switching elements to be turned on in different time.

Preferably, in the testing stage, the array substrate controls a voltage signal to be input to the voltage input terminal so that the voltage signal is received by the third conducting terminals of the second switching elements connected to the voltage input terminal and the voltage signal is transmitted through the turned-on second switching elements to corresponded data lines.

The present embodiment and the embodiment shown in FIG. 3-FIG. 4 are based on the same concept and having the same technique effects. The specific principles can be referred to the descriptions of the embodiment shown in FIG. 3-FIG. 4 and are not described again here.

The descriptions of the embodiments mentioned above are addressed in different parts while describing different embodiments. Once there is something not described in detail in any embodiment, the related description could be found in descriptions of other embodiments.

The embodiments above are only for describing the technique solutions of but not limiting the present invention. Although the detailed descriptions are made in reference to the embodiments, it can be understood by those with ordinary skill in the art that the technique solutions described in the embodiments can still be modified, or a part or all of the technique features can be equivalently substituted. These modifications or substitutions would not make the essences of the technique solutions beyond the scope of the corresponded technique solutions of the embodiments of the present invention.

What is claimed is:

1. An array substrate comprising a display area and a non-display area formed around boundaries of the display area, wherein the display area comprises a plurality of pixel units arranged in matrix for displaying an image and a plurality of data lines for connecting the pixel units, the data lines are used for providing data signals to the pixel units and are extended along a first direction, the non-display area comprises a testing circuit, and the array substrate is characterized in that the testing circuit comprises:

a test switching control terminal to which a test switching control signal is input, a first test control terminal to which a low voltage level signal is input, and a first number of a plurality of second test control terminals to which a test signal is input;

a switching unit comprising the first number of a plurality of first switching elements, wherein the first switching elements are parallelly arranged along the first direction and are connected to the test switching control terminal and the first test control terminal, and the switching unit controls the array substrate to be in a non-testing status in accordance with the test switching control signal; and a plurality of testing units parallelly arranged along a second direction perpendicular to the first direction, wherein each of the testing units is connected to the switching unit, the second test control terminals and the first number of corresponded data lines, and the testing units test electrical characteristics of the corresponded data lines and pixel units when the switching unit controls the array substrate to be in a testing status in accordance with the test switching control signal, wherein each first switching element comprises a first control terminal, a first conducting terminal and a second conducting terminal, wherein the first conducting terminals of the first number of the first switching elements are connected to the first test control terminal, the first control terminals of the first number of the first switching elements are connected to the test switching control terminal, and the second conducting terminals of the first number of the first switching elements are connected to the testing units;

wherein each of the testing units comprises a voltage input terminal and the first number of a plurality of second switching elements, the first switching elements are corresponding to the second switching elements one by one, and each of the second switching elements comprises a second control terminal, a third conducting terminal and a fourth conducting terminal, wherein the second control terminals of the second switching elements are connected to the second conducting terminals of the first switching elements and the second test control terminals, the third conducting terminals of the second switching elements are connected to the voltage input terminal, and the fourth conducting terminals of the second switching elements are connected to the data lines.

2. The array substrate according to claim 1, being characterized in that, in a testing stage, the test switching control signal is input to the test switching control terminal, the test switching control signal is received by the first control terminals of the first switching elements connected to the test switching control terminal, and the test switching control signal is low potential to control the first switching elements to be terminated;

the test signal is input to the first number of the second test control terminals, the test signal is received by the second control terminals of the first number of the second switching elements connected to the first number of the second test control terminals, and the test signal is used for controlling the first number of the second switching elements to be turned on in different time;

a voltage signal is input to the voltage input terminal, the voltage input terminal is received by the third conducting terminals of the second switching elements connected to the voltage input terminal, and the voltage signal is transmitted to corresponded data lines through the turned-on second switching elements.

3. The array substrate according to claim 1, being characterized in that the low voltage level signal is input to the first test control terminal, and the low voltage level signal is used for controlling the second switching elements corresponding to the first switching elements to be terminated when the first switching elements connected to the first test control terminal are turned on.

4. The array substrate according to claim 3, being characterized in that, in a non-testing stage, the test switching control signal is input to the test switching control terminal, the test switching control signal is received by the first control terminals of the first switching elements connected to the test switching control terminal, and the test switching control signal is high potential to control the first switching elements to be turned on;

the low voltage level signal input to the first test control terminal is transmitted to the second switching elements corresponding to the turned-on first switching elements, the low voltage level signal is received by the second control terminals of the second switching elements, and the low voltage level signal controls the second switching elements to be terminated to cut off connections between the testing circuit and the data lines.

5. A display apparatus characterized in comprising the array substrate claimed in claim 1.

6. The display apparatus according to claim 5, being characterized in that, in a testing stage, the test switching control signal is input to the test switching control terminal, the test switching control signal is received by the first control terminals of the first switching elements connected to the test switching control terminal, and the test switching control signal is low potential to control the first switching elements to be terminated;

the test signal is input to the first number of the second test control terminals, the test signal is received by the second control terminals of the first number of the second switching elements connected to the first number of the second test control terminals, and the test signal is used for controlling the first number of the second switching elements to be turned on in different time;

a voltage signal is input to the voltage input terminal, the voltage input terminal is received by the third conducting terminals of the second switching elements connected to the voltage input terminal, and the voltage signal is transmitted to corresponded data lines through the turned-on second switching elements.

7. The display apparatus according to claim 5, being characterized in that the low voltage level signal is input to the first test control terminal, and the low voltage level signal is used for controlling the second switching elements corresponding to the first switching elements to be terminated when the first switching elements connected to the first test control terminal are turned on.

8. The display apparatus according to claim 7, being characterized in that, in a non-testing stage, the test switching control signal is input to the test switching control terminal, the test switching control signal is received by the first control terminals of the first switching elements connected to the test switching control terminal, and the test switching control signal is high potential to control the first switching elements to be turned on;

the low voltage level signal input to the first test control terminal is transmitted to the second switching elements corresponding to the turned-on first switching elements, the low voltage level signal is received by the second control terminals of the second switching elements, and the low voltage level signal controls the second switching elements to be terminated to cut off connections between the testing circuit and the data lines.

9. A testing method being used for testing a pixel array in an array substrate, wherein the array substrate comprises a display area and a non-display area formed around boundaries of the display area, the display area comprises a plurality of pixel units arranged in matrix for displaying an image and a plurality of data lines for connecting the pixel units, the data lines are used for providing data signals to the pixel units, the non-display area comprises a testing circuit, and the testing circuit comprises a test switching control terminal, a first test control terminal, a first number of a plurality of second test control terminals, a switching unit and a plurality of testing units, wherein the switching unit comprises the first number of a plurality of first switching elements parallelly arranged along a first direction, each of the first switching elements comprises a first control terminal, a first conducting terminal and a second conducting terminal, the testing units are parallelly arranged along a second direction perpendicular to the first direction, each of the testing units comprises a voltage input terminal and the first number of a plurality of second switching elements, the first switching elements are corresponding to the second switching elements one by one, and each of the second switching elements comprises a second control terminal, a third conducting terminal and a fourth conducting terminal, being characterized in that the testing method comprises:

in a non-testing stage, controlling the first number of the first switching elements to be turned on and controlling a low voltage level signal input to the first test control terminal to be transmitted through the first number of the turned-on first switching elements to the corresponded second switching elements to terminate the second switching elements to cut off connections between the testing circuit and the data lines; and in a testing stage, controlling the first number of the first switching elements to be terminated and controlling the testing units in accordance with a test signal input to the first number of the second test control terminals to test electrical characteristics of the corresponded data lines and pixel units.

10. The testing method according to claim 9, being characterized in that controlling the first number of the first switching elements to be terminated and controlling the testing units in accordance with the test signal input to the first number of the second test control terminals to test electrical characteristics of the corresponded data lines and pixel units comprises:

controlling a low potential signal to be input to the test switching control terminal so that the first control terminals of the first number of the first switching elements connected to the test switching control terminal receive the low potential signal, wherein the low potential signal controls the first switching elements to be terminated;

controlling the test signal to be input to the first number of the second test control terminals so that the second control terminals of the first number of the second switching elements connected to the second test control terminal receive the test signal, wherein the test signal is used for controlling the first number of the second switching elements to be turned on in different time;

controlling a voltage signal to be input to the voltage input terminal so that the voltage signal is received by the third conducting terminals of the second switching elements connected to the voltage input terminal and the voltage signal is transmitted through the turned-on second switching elements to corresponded data lines.

11. The testing method according to claim 9, being characterized in further comprising:

controlling the low voltage level signal to be input to the first test control terminal, wherein the low voltage level signal is used for terminating the second switching elements corresponding to the turned-on first switching elements connected to the first test control terminal.

12. The testing method according to claim 11, being characterized in that controlling the first number of the first switching elements to be turned on and controlling the low voltage level signal input to the first test control terminal to be transmitted to the second switching elements corresponding to the first number of the turned-on first switching elements through the turned-on first switching elements to terminate the second switching elements comprises:

controlling a high potential signal to be input to the test switching control terminal so that the first control terminals of the first number of the first switching elements connected to the test switching control terminal receive the high potential signal, wherein the high potential signal controls the first number of the first switching elements to be turned on;

controlling the low voltage level signal input to the first test control terminal to be transmitted through the turned-on first switching elements to the corresponded second switching elements so that the low voltage level signal is received by the second control terminals of the second switching elements, wherein the low voltage level signal controls the second switching elements to be terminated.

* * * * *